United States Patent [19]

Sin

[11] 4,169,315

[45] Oct. 2, 1979

[54] ELLIPSOGRAPH

[76] Inventor: Lin Sin, 135-2, Lane 120, Hu-Lin St., Taipei, Taiwan

[21] Appl. No.: 926,857

[22] Filed: Jul. 21, 1978

[51] Int. Cl.[2] ..... B43L 11/04

[52] U.S. Cl. ..... 33/30 C

[58] Field of Search ..... 33/30 R, 30 B–30 D, 33/30 E, 30 F

[56] References Cited

U.S. PATENT DOCUMENTS

| | | | |
|---|---|---|---|
| 1,637,507 | 8/1927 | Zavagno | 33/30 C |
| 2,645,854 | 7/1953 | Dibrell | 33/30 C |
| 3,085,341 | 4/1963 | Lundebjerg | 33/30 C |

*Primary Examiner*—Charles E. Phillips

[57] ABSTRACT

An ellipsograph utilizing dynamic projection method for drawing an ellipsoid comprising a central rod having a circle cap formed on the top portion thereof and a positioning needle secured at the end thereof; a sleeve on said central rod having a pair of horizontal beams secured thereto and extending radially therefrom; a pair of supports connected to said horizontal beams for holding a circle; a pair of guide balls inserted in the circular slot of the circle for defining the inclination of the circle; a rotational rod engaged with the sleeve having a pen stand and a roller seat equipped thereon; and a major axis rod slidable through a guide tube which is eccentrically secured to the circle. The circle preserves a fixed inclined position so that the path of the drawing pen on the pen stand will be elliptical, forming a truly mathematical ellipsoid.

9 Claims, 6 Drawing Figures

ELLIPSOGRAPH

BACKGROUND OF THE INVENTION

1. Field of the Invention

The present invention relates to an ellipsograph and particularly to an ellipsograph utilizing a dynamic projection method for drawing an ellipsoid.

2. Description of the Prior Art

For centuries, people have been trying to develop a handy ellipsograph which can draw an ellipsoid very conveniently.

Most of the conventional ellipsographs can only draw an approximate ellipsoid instead of a truly mathematical ellipsoid.

Furthermore, the conventional ellipsographs are usually complex in their structure and in the setting of major and minor axes.

BRIEF SUMMARY OF THE INVENTION

The main object of the present invention is to provide an ellipsograph utilizing a dynamic projection method for drawing an ellipse. The ellipsograph is provided with a circle which can be adjusted to an inclined position as the projection basis.

Another object of the present invention is to provide a pair of supports for holding the circle. The supports are connected to the horizontal beams and are able to rotate relative to the beams for setting said circle at an inclined position.

A further object of the present invention is to provide a pair of guide balls which are inserted in the circular slot of said circle for guiding the circle to rotate at a fixed inclination to draw an ellipsoid.

Those and other objects and advantages will become apparent from the following detailed description of the preferred embodiment with reference to the accompanying drawings.

DETAILED DESCRIPTION OF THE PREFERRED EMBODIMENT

Figures 1, 3, 4:
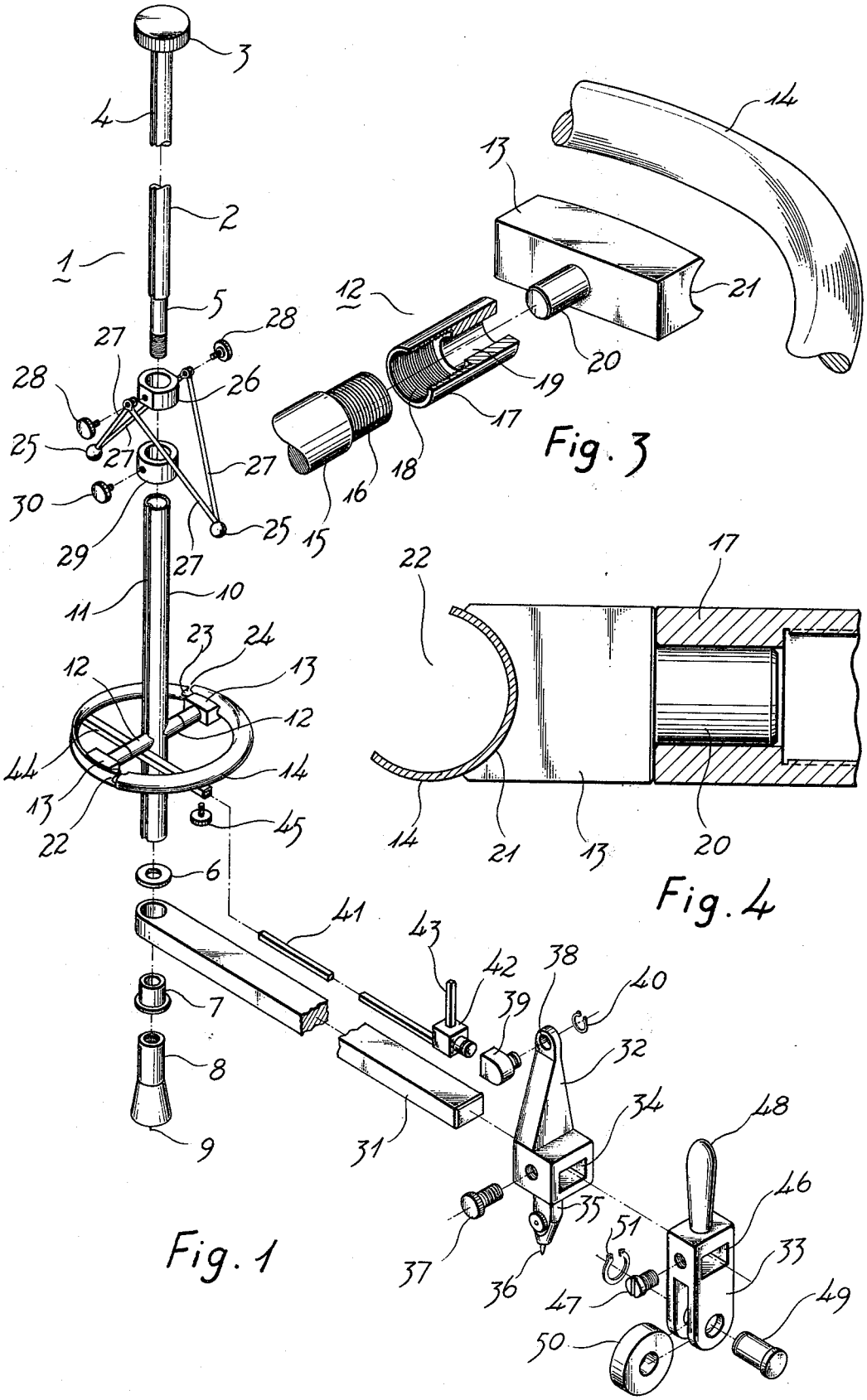
FIG. 1 is an exploded view of an ellipsograph according to the present invention.
FIG. 3 is an enlarged exploded view of the horizontal beam and support of the ellipsograph according to the present invention.
FIG. 4 is an enlarged partially sectional view of the horizontal beam, the support and the circle according to the present invention.
Figures 2, 5, 6:
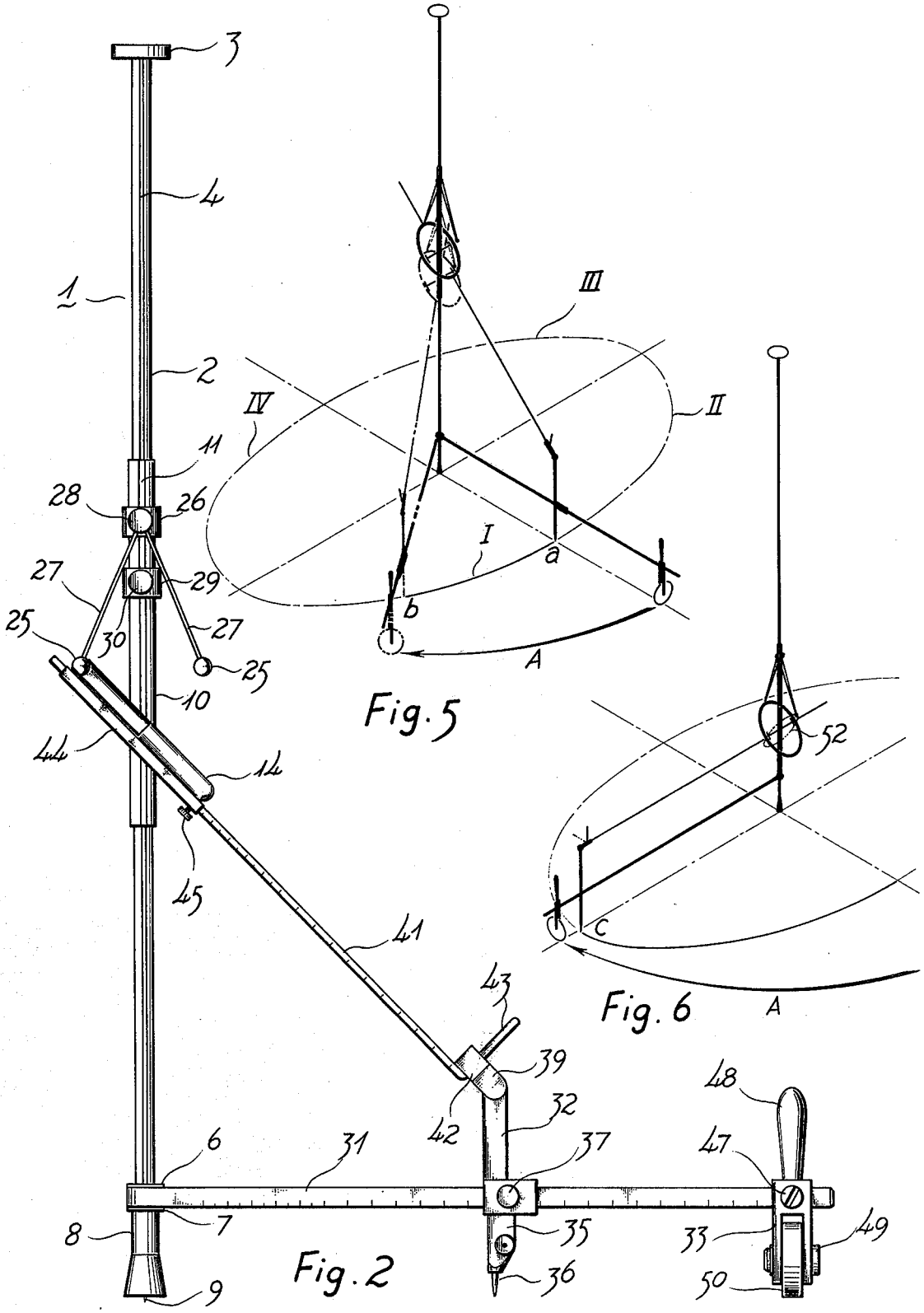
FIG. 2 is a front view of the ellipsograph according to the present invention.
FIG. 5 is a schematic diagram of an ellipsoid drawing using the ellipsograph according to the present invention.
FIG. 6 is another schematic diagram of an ellipsoid drawing when the ellipsograph is at the major axis position.

FIGS. 1 and 2 show the exploded and front view of the ellipsograph of the present invention. The ellipsograph 1 comprises a central rod 2 with a circle cap 3 formed on the top portion thereof for a user to hold during the ellipsoid drawing. The central rod 2 has an elongate recess 4 parallel to the axis thereof, and a narrowed portion 5 with threads formed on the surface thereof for adapting a ring plate 6, a bearing 7 and connection to a positioning disc 8 further comprises a positioning needle 9 extending from the bottom face thereof for the setting of the ellipsoid center. A sleeve 10, ringed on the central rod 2, has a recess 11 formed thereon coincident with the recess 4 of the central rod 2. Therefore, the sleeve 10 may only move up and down with respect to the central rod 2 without relative rotation therebetween.

Near the lower portion of the sleeve 10, a pair of horizontal beams 12 are secured to the sleeve 10 and extended radially from the opposite sides of the sleeve 10. A pair of supports 13 are adapted to the horizontal beams respectively for holding a circle 14. FIG. 3 shows an enlarged exploded view of the horizontal beam and support of the ellipsograph according to the present invention. The horizontal beam 12 consists of a first part 15 secured to and radially extending from the sleeve 10 having male threads 16 formed thereon and a second part 17 in the shape of a tube having at one end the female threads 18 for connecting with said first part 15, while the other end a cylindrical chamber 19 for accepting the stud 20 of the support 13. The contacting surface 21 of the support 13 is part of a circle for engaging with the circle 14.

FIG. 4 shows an enlarged partially sectional view of the horizontal beam, the support and the circle of the ellipsograph according to the present invention. During assembling, the second part 17 of the horizontal beam 12 is rotated for pushing the support 13 against the circle 14 until said support 13 can steadily hold the circle 14 in position. In addition, with reference to FIG. 1, the circle 14 comprises a half portion being a tube, another half portion being cut away two fifths as a circular slot 22, and an opening 23 formed on the inner radius surface thereof at the joint of said tube portion and circular slot 22. A slit 24 is provided on the circle 14 for communicating said opening 23 with said circular slot 22. The diameter of the opening 23 is slightly greater than the diameter of the guide ball 25 which will be described hereinafter.

Referring to FIG. 1 again, a ring 26 is put on the upper portion of the sleeve 10. A pair of guide balls 25, each having a pair of links 27 with the ends thereof formed into a flat ring plate, are connected to said ring 26 and in turn to the sleeve 10 by screws 28. An adjusting ring 29 can move up and down on the sleeve 10 for setting the departure between two guide balls, and is connected to the sleeve 10 by a screw 30.

Still referring to FIGS. 1 and 2, a rotational rod 31 is engaged with one end thereof to the bearing 7 on the central rod 2, and has a pen stand 32 and a roller seat 33 equipped thereon. The pen stand 32 has a rectangular opening 34 for engaging with the rotational rod 31, a pen seat 35 for a drawing pen 36 being adapted thereon, and a screw 37 for fixing the pen stand 32 to the rotational rod 31 to determine the minor axis. The top portion of the pen stand 32 is formed into a ringlet 38 for engaging with a trap 39 by a clip 40. A major axis rod 41 has a connector 42 formed at one end thereof which is connected to said trap 39 and these can rotate with respect to each other without departure. An adjusting rod 43 is provided on the connector 42 of the major axis rod 41 which is usually in rectangular shape and is slidable through a guide tube 44 which is eccentrically connected on said circle 14. The major axis rod 41 can be fixed by a screw 45. The roller seat 33 comprises a rectangular opening 46 for engaging with the rotational rod 31, a screw 47 for fixing the roller seat 33 to the rotational rod 31, a handle 48 formed on the top portion thereof for drawing, and a roller 50 attached thereto by a pin 49 which is fixed by a clip 51.

The structure of the ellipsograph has been described hereabove. In operation of drawing an ellipsoid, with reference to FIG. 2, the user firstly sets the positioning needle 9 of the central rod 2 at the center of the ellipsoid which is to be drawn. After turning loose all the fixing screws 28, 30, 37, 45, one pushes the pen stand 32 along the rotational rod 31 to set the minor axis and then turns tight the screw 37 temporarily. One then moves the sleeve 10 along the central rod 2 up or down to incline the circle 14 to a certain degree where the length of the major axis rod 41 exactly equals to the major axis of the ellipsoid to be drawn. The screw 45 is then turned tight. By adjusting the links 27 of the guide balls 25 making the latter get into the circular slot 22 of the circle 14, the user can then fix the adjusting ring 29 and the ring 26 by turning tight the screws 30 and 28 so as to complete the performance of major and minor axes setting. Turning loose again the screw 37, one can start to draw the ellipsoid.

Referring again to FIG. 2 with reference to FIGS. 5 and 6, the user with one hand holds tight the circle cap 3 and with the other hand holds the handle 48 of the roller seat 33, pushing the rotation rod 31 in the arrow direction A to make the roller 50 move along a circular path while the drawing pen 36 moves along an elliptical path from point a to point b. The reason why the drawing pen 36 moves along an elliptical path is explanatarily described herebelow. When the rotational rod 31 moves, the major axis rod 41 together with the guide tube 44 and the circle 14 will follow to move. Because the guide ball 25 is inserted in the circular slot 22 of the circle 14, the circle 14 shall preserve the inclined position without any change. Further because the major axis rod 41 has been fixed to the length of the major axis of the ellipsoid to be drawn, the circle 14 together with the sleeve 10 will move downward gradually and the major axis rod 41 will become horizontal gradually. The lower the sleeve 10, the more horizontal the major axis rod 41 will become. When the major axis rod 41 has come to a complete horizontal position, the drawing pen 36 will be at point C (as shown in FIG. 6) and a quarter of the ellipsoid is drawn. Due to the fact that the circle 14 keeps its inclined position during the drawing operation, the obtained path or locus is the projection of said inclined circle 14 and is a truly mathematical ellipsoid. A quarter of the ellipsoid I is drawn from the above description. The other quarter of the ellipsoid II can be drawn by the similar operation except moving the rotational rod 31 to a reverse direction from point a.

When the rotational rod 31 moves to point c as shown in FIG. 6, the major axis rod is at a horizontal position and so is the guide tube 44. By referring to the construction of the ellipsograph in FIGS. 1 and 2, it is noted that the opening 23 of the circle 14 now meets the guide ball 25. By pushing the adjusting rod 43, one of the guide balls 25 together with the links 27 shall leave the circular slot 22 from opening 23 and slit 24 and the other guide ball shall get into the circular slot 22, to turn the circle 14 to a position shown by dashed line 52 in FIG. 6. After this change, the other half of the ellipsoid path III and IV can be drawn. Because two guide balls 25 have been adjusted symmetrically with respect to the central rod 2, the inclination of the circle 14 is identical to that of drawing ellipsoid path I and II and a complete ellipsoid is drawn.

In summary, the ellipsograph according to the present invention can draw a truly mathematical ellipsoid and has the advantages of convenient assembly and easy setting of major and minor axes.

What is claimed is:

1. An ellipsograph utilizing dynamic projection method for drawing an ellipsoid comprising a central rod having a circle cap formed on the top portion thereof and screw connected to a positioning disc which further comprises a positioning needle extending from the bottom face thereof; a sleeve on said central rod; a pair of horizontal beams secured to and extending radially from said sleeve, connecting to a pair of supports respectively; a circle held by said supports; a pair of guide balls connected through links to a ring of said sleeve by screws; a rotational rod engaged with said sleeve having a pen stand and a roller seat equipped thereon; and a major axis rod slidable in a guide tube which is eccentrically secured to said circle; said major axis rod further comprises a connector by which to connect with a trap of said pen stand forming a rotatable joint; so as to draw an ellipsoid path when said rotational rod is pushed to move.

2. An ellipsograph according to claim 1, wherein said central rod and said sleeve further include elongated recesses parallel to the axes thereof respectively to enable relative up and down movement but without rotation therebetween.

3. An ellipsograph according to claim 1, wherein said circle further comprises a first half portion being a tube, a second half portion being cut away approximately two fifths as a circular slot and an opening formed on the inner radius surface thereof at the joint of said first and second half portions, communicating to said circular slot through a slit.

4. An ellipsograph according to claim 1, wherein each said horizontal beam further comprises a first part secured to and radially extending from said sleeve and having male threads formed thereon, a second part in the shape of a tube having at one end thereof female threads for connecting with said male threads and at the other end having a cylindrical chamber for accepting a stud one of said supports.

5. An ellipsograph according to claim 1, further comprising an adjusting ring on said sleeve and screwed thereto by screws for keeping said pair of guide balls in the position symmetrical to the central rod.

6. An ellipsograph according to claim 1, wherein said guide balls are inserted in said circular slot of the circle to keep the latter preserving a fixed inclined position during the drawing operation.

7. An ellipsograph according to claim 1, wherein said major axis rod comprises a connector which is connected to the trap; said trap is connected to the ringlet of the pen stand; said trap and the ringlet forming a rotatable joint enabling said major axis rod to be adjusted for the setting of major axis of the ellipsoid to be drawn.

8. An ellipsograph according to claim 1, wherein said pen stand further comprises a rectangular opening engaging with the rotational rod enabling said pen stand to move along the rotational rod for the setting of the minor axis of the ellipsoid to be drawn.

9. An ellipsograph according to claim 1, wherein said roller seat further comprises a handle formed on the top portion thereof, a rectangular opening for engaging with said rotational rod and a roller attached thereto by a pin.

* * * * *